United States Patent [19]

Huang

[11] Patent Number: 4,780,571

[45] Date of Patent: Oct. 25, 1988

[54] COMBINED FLOOR PEDESTAL AND FLOOR OUTLET

[76] Inventor: Chien-Teh Huang, No. 105, Sec. 4, San-Ho Rd., Sanchung City, Taipei Hsien, Taiwan

[21] Appl. No.: 58,950

[22] Filed: Jun. 5, 1987

Related U.S. Application Data

[63] Continuation-in-part of Ser. No. 889,508, Jul. 25, 1986, abandoned, which is a continuation-in-part of Ser. No. 752,569, Aug. 7, 1985, abandoned.

[51] Int. Cl.[4] ..... E04F 15/024

[52] U.S. Cl. ..... 174/48; 52/126.6; 52/221

[58] Field of Search ..... 174/48, 49; 52/126.2, 52/126.6, 126.7, 221

[56] References Cited

U.S. PATENT DOCUMENTS 3,025,934 3/1962 Spiselman et al. ..... 52/481 X
3,157,254 11/1964 Spiselman et al. ..... 52/126.1
3,398,933 8/1968 Haroldson ..... 248/354.3 X
3,425,179 2/1969 Haroldson ..... 52/301 X
4,685,258 8/1987 Av-Zuk ..... 52/126.6

*Primary Examiner*—Arthur T. Grimley
*Assistant Examiner*—David A. Tone
*Attorney, Agent, or Firm*—Finnegan, Henderson, Farabow, Garrett and Dunner

[57] ABSTRACT

A combined floor pedestal and floor outlets which include a base drum and a support drum interconnected by an adjustment sleeve member which is sleeved around and threadedly connected to the base drum and a support drum. The support drum has a top annular bearing face with grooves and projections to support and engage with floor rails and receives a plug body which has sockets mounted thereon to be used for electrical connection on the floor. The support drum is also provided with sockets means connected to the sockets of the plug. The assembly is convenient for making height adjustments as well as electrical connection.

3 Claims, 3 Drawing Sheets

COMBINED FLOOR PEDESTAL AND FLOOR OUTLET

This application is a continuation-in-part application of U.S. patent application Ser. No. 889,508 filed on July 25, 1986 which is abandoned and which is a continuation-in-part applicatin of U.S. patent application Ser. No. 752,569 filed on Aug. 7, 1985 which is abandoned.

BACKGROUND OF THE INVENTION

This invention relates to a raised false floor set up in computer and control rooms, and particularly to a combined floor pedestal and floor out assembly for supporting floor rails which in turn hold floor panels.

Pedestal assemblies for supporting a raised false floor exist various forms in the prior art. U.S. Pat. No. 4,438,610 discloses a pedestal assembly which includes a height-adjustable, telescopic shaft of two sections with an enlarged base and a top bearing plate with a clamping means to support and clamp floor panels. Such a pedestal assembly is found to be disadvantageous since the telescopic shaft, which is slim and threaded, and the bearing top plate are susceptible to damage when subjected to heavy loads, especially when the base floor below is uneven. Furthermore, it is inconvenient to adjust the height of the pedestals after the panels are installed thereon.

U.S. Pat. No. 572,836 to Sorsoleil and U.S. Pat. No. 651,511 disclose height-adjustable telescopic pipe constructions to be placed under ground surface for supplying water and gas. These constructions can be adjusted in height to be flush with the ground surface, and are designed to be used as connectors rather than as supports which must usually be adjusted in height after supported elements are mounted thereon.

U.S. Pat. No. 3,398,933 discloses a pedestal assembly, as shown in FIG. 1, in which a nut is employed to adjust the height of a threaded rod which is inserted slideably in a lower tubular support with a bottom flange. The threaded rod is also provided with a top bearing plate. Such a construction is also weak.

Floor outlets for a raised floor are also known in the arts. U.S. Pat. Nos. 1,767,323, 2,996,566 and 3,794,956 disclose floor outlet devices by means of which an apparatus, such as a computor, telephone, telegrpaph instrument, light, etc., may be readily connected with electric conductors disposed under a floor. Such floor outlets generally include a hollow cylindrical support body, and a plug body inserted in the support body in a telescopic manner and having an electric outlet means mounted thereon.

An object of the invention is to provide a combined floor pedestal and floor outlet which has a strong pedestal and a strong bearing face for supporting floor rail and by which additional requirements for installing floor outlets can be eliminated.

Another object of the invention is to provide a combined floor pedestal and floor outlet assembly which is convenient for height adjustment even after floor rails are mounted on the assembly, and which has a height adjustment member capable of changing the height of the pedestal upon slight turning of the adjustment member.

SUMMARY OF THE INVENTION

The invention provides a combined floor pedestal and floor outlet which includes upper and lower threaded cylindrical members of enlarged cross-section interconnected by a threaded adjustment sleeve member which is sleeved around the upper and lower cylindrical members. The upper cylindrical member is provided with at its top annular portion radial grooves spaced apart from each other and opening at the periphery and the top face for receiving floor rails and upstanding projections to engage with floor rails. The screw threads on the adjustment sleeve member are arranged such that they can cause the screw threads of the upper and lower cylindrical members to advance simultaneously into the sleeve member. By slight turning of the adjustment sleeve member, the upper and lower cylindrical member can move inwardly or outwardly simultaneously relative to the adjustment sleeve member, changing appreciably the totel height of the pedestal. On the upper cylindrical member is mounted a plug body in a telescopic manner. The plug body includes first electric socket means which are connected with second electric socket means disposed in the upper cylindrical member, thereby enabling the wires below the floor to be connected easily to the electric elements on the floor. The pedestal assembly is particularly so arranged that the height adjustment of assembly can be effected independently of the parts incorporating floor outlet means so that the adjustment therefor does not change the position of the floor outlet means or affect the arrangement of the wiring system below the false floor.

The present exemplary preferred embodiment will be described in detail with reference to the accompanying drawings, in which:

DETAILED DESCRIPTION OF THE PREFERRED EMBODIMENT

Figure 1:
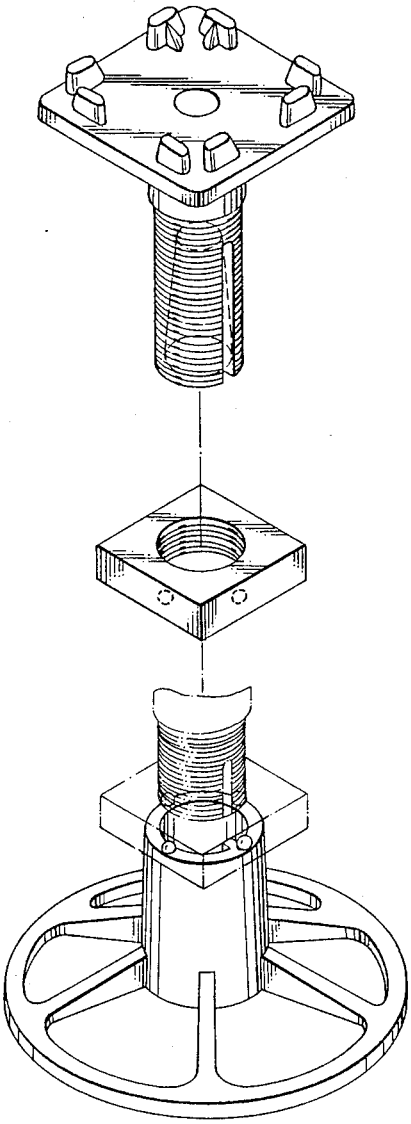
FIG. 1 PRIOR ART
FIG. 1 shows a known pedestal assembly.
Figure 2:
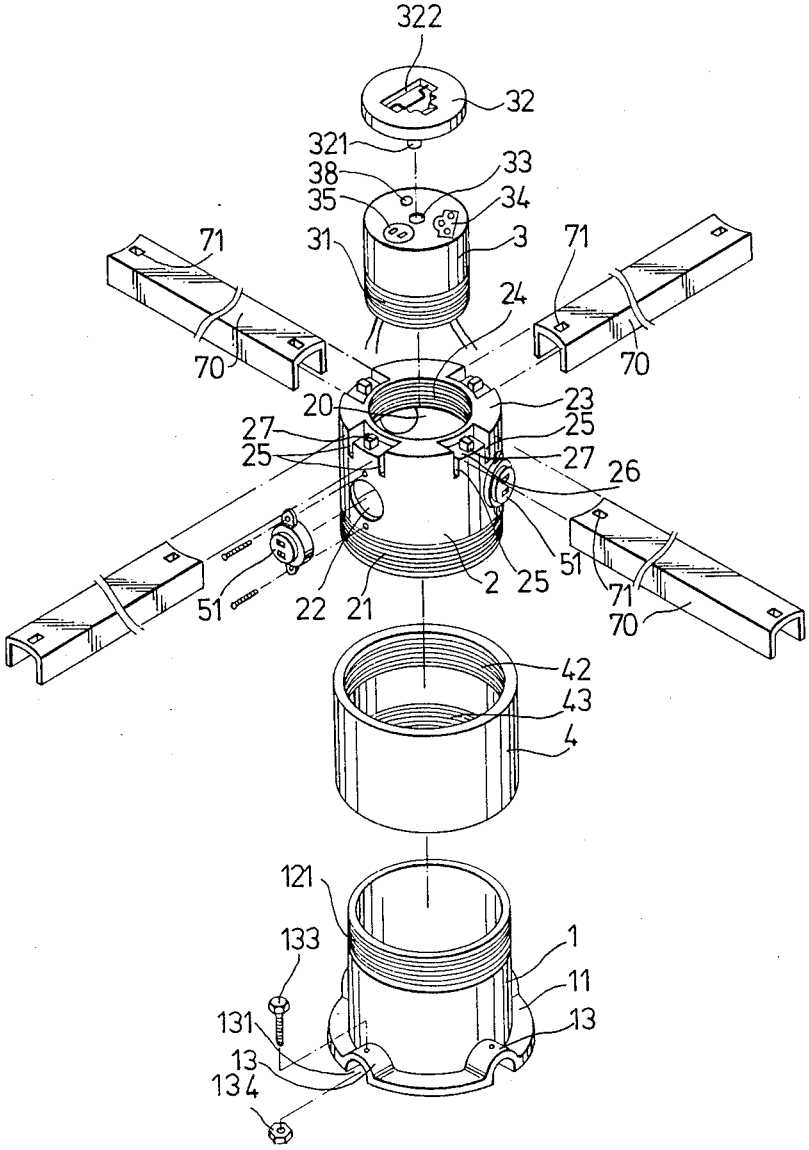
FIG. 2 is an exploded view of a combined floor support and floor outlet assembly according to the invention.
Figure 3:
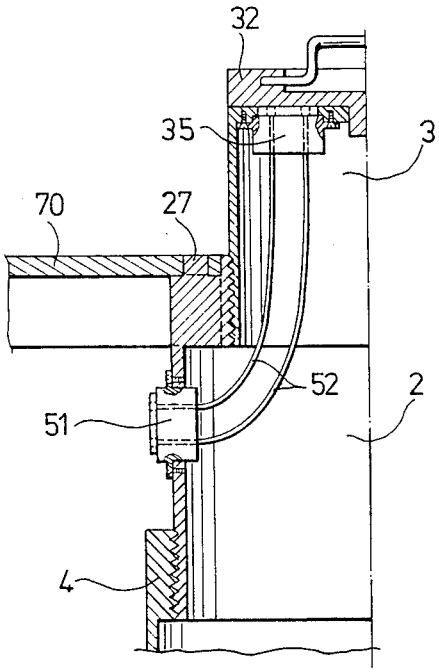
FIG. 3 is a fragmentary sectional view of the support member showing how electric sockets thereof are interconnected.

Referring to FIGS. 2 and 3, there is shown a pedestal assembly according to the present invention which includes a base drum member 1, an adjustment sleeve member 4, a support drum member 2 and a cylindrical plug body 3. The base member 1 has a radially extending bottom flange 11 having four upwardly arched portions 13 each defining a passage 131. Nut 134 and screw 133 are attached to each arched portion 13 to be used for grounding. At the upper portion of the base member is an external righthand screw thread 121.

The adjustment sleeve member 4 has a cylindrical wall with an upper left-hand internal screw thread 42 and a lower right-hand internal screw thread 43. The lower right-hand internal screw thread 43 is engaged with the external screw thread 121 of the base member.

Above the adjustment sleeve member 4 is the support member 2 which has a lower external left-hand screw thread 21 engaging with the internal left-hand screw thread 42 of the adjustment sleeve member 4. In the peripheral wall of the support member 2 are provided openings 22 at intervals to be used for attachment of electric socket members 51. The socket members 51 are fitted in the openings 22 respectively by means of screws. At the upper portion of the support member 2 is an annular top bearing face 23 and an internal screw thread 24. The top bearing face 23 is provided with four pairs of radial grooves 25 spaced apart from each other, extending radially and opening at the periphery and at the top annular face of the support member 2 for receiving four rails 70. Between each pair of radial grooves 25 is a recessed face 26 on which is disposed an upstanding projection 27 for engaging the holes 71 of the floor rails 70.

The cylindrical plug 3 is fitted in the hole 20 of the drum support, and provided with an external screw thread 31 to engage with the internal screw thread 24. At the top of the plug 3 are disposed electric sockets 34 and 35 which are connected electrically in a conventional manner with electric sockets 51 of the support 2 by means of conductors 52 as shown in FIG. 3. A hole 38 is provided on the plug body 3, through which a grounding wire (not shown) can extend from above the floor to the bottom flange 11 of the base drum 1.

On the plug body 3 is a circular cover plate 32 having a bottom attachment protrusion 321 used to penetrate into a hole 33 of the plug body 3 so as to cover the electric sockets 34 and 35 when no electric connection is desired. A pull ring 322 is attached to the cover plate 32 for ease of uncovering the plug body 3.

It can be appreciated that the assembly according to the invention has an advantage in that the height of the assembly can be adjusted after the floor rails 70 are mounted on the support 2. The adjustment can be effected by turning the adjustment sleeve member 4. The adjustment sleeve member 4 can make both screw threads 21 and 121 move into or move outward simultaneously when it is turned so that the height of the assembly can be changed appreciably with a slight turn of the adjustment sleeve. Furthermore, the top bearing face 23 of the support 2 is stronger than the top bearing plate of the pedestals described hereinbefore.

With the invention thus explained, it is apparent that various modifications and variations can be made without departing from the scope of the invention. It is therefore intended that the invention be limited only as indicated in the appended claims.

What I claim is:

1. A combined floor pedestal and floor outlet comprising:

a drum base member having a cylindrical wall with an external screw thread on said cylindrical wall, and a bottom end flange extending radially at the bottom of said cylindrical wall;

a sleeve member having a cylindrical wall with a first internal screw thread at a lower portion of said cylindrical wall of said sleeve member and a second internal screw thread at an upper portion of said cylindrical wall of said sleeve member, said sleeve member being sleeved around the upper portion of said drum base member, said first internal thread engaging with said external thread of said drum base, a support member having a cylindrical wall substantially similar in cross-section to said drum base member, said support member being inserted in said sleeve member, said cylindrical wall of said support member including a top annular portion which has radial grooves for receiving floor rails, opening at the periphery and the top face of said top annular portion, and upstanding projections for engaging with the floor rails, an external thread at a lower portion of said cylindrical wall of said support member, engaging with said second internal thread of said sleeve member, an internal thread at an upper portion of said cylindrical wall of said support member, and first electric socket means disposed in said cylindrical wall of said support member below said grooves; said first and second internal threads of said sleeve member being arranged such that they cause said external threads of said drum base member and said support member to advance in opposite directions when said sleeve member is turned; and a plug body inserted in said support member and including a cylindrical wall having an external thread engaging with said internal thread of said support member, and a top end having a second electric socket means mounted thereon, said second electric socket means being connected electrically to said first electric socket means.

2. A pedestal assembly as claimed in claim 1, further comprising a top cover mounted detachably on said plug body.

3. A pedestal assembly as claimed in claim 1, wherein said bottom end flange of said drum base member has upwardly arched portions for receiving grounding wires and screw means for connecting said wires to said arched portions.

* * * * *